US006059676A

United States Patent [19]

Seymour et al.

[11] Patent Number: 6,059,676

[45] Date of Patent: May 9, 2000

[54] ILLUMINATED FOOTBAG

[76] Inventors: David R. Seymour; Robert Lanctot, both of 1802 NW. Baldwin, Lawton, Okla. 73507

[21] Appl. No.: 09/168,486

[22] Filed: Oct. 8, 1998

[51] Int. Cl.[7] ..... A63B 43/06

[52] U.S. Cl. ..... 473/570; 473/594

[58] Field of Search ..... 473/570, 594

[56] References Cited

U.S. PATENT DOCUMENTS

| | | | |
|---|---|---|---|
| 4,717,158 | 1/1988 | Pennisi | 473/570 |
| 4,943,066 | 7/1990 | Lathim et al. | 473/594 X |
| 5,102,131 | 4/1992 | Remington et al. | 473/570 |
| 5,186,458 | 2/1993 | Redondo | 473/570 |
| 5,228,686 | 7/1993 | Maleyko | 473/570 |
| 5,490,047 | 2/1996 | O'Rourke et al. | 473/570 |
| 5,609,411 | 3/1997 | Wang | 473/570 X |
| 5,639,076 | 6/1997 | Cmiel et al. | 473/570 |
| 5,725,445 | 3/1998 | Kennedy et al. | 473/570 |
| 5,779,574 | 7/1998 | Allman et al. | 473/570 |
| 5,807,197 | 9/1998 | Grafton | 473/594 |
| 5,830,034 | 11/1998 | Ciechanowski et al. | 473/570 X |

*Primary Examiner*—Raleigh W. Chiu

[57] ABSTRACT

An illuminated footbag for increasing the visibility of the footbag in low light conditions such as at night. The illuminated footbag includes a generally translucent footbag having a cavity therein with a light source provided in the cavity for illuminating the footbag.

18 Claims, 3 Drawing Sheets

ILLUMINATED FOOTBAG

BACKGROUND OF THE INVENTION

1. Field of the Invention

The present invention relates to footbags, commonly known as hacky-sacks, and more particularly pertains to a new illuminated footbag for increasing the visibility of the footbag in low light conditions such as at night.

2. Description of the Prior Art

The use of footbags is known in the prior art. More specifically, footbags heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,228,697; U.S. Pat. No. 4,613,403; U.S. Pat. No. 4,151,994; U.S. Pat. No. 5,445,373; U.S. Pat. No. 5,403,000; and U.S. Pat. No. Des. 292,014.

While these devices fulfill their respective, particular objectives and requirements, the aforementioned patents do not disclose a new illuminated footbag. The inventive device includes a generally translucent footbag having a cavity therein with a light source provided in the cavity for illuminating the footbag.

In these respects, the illuminated footbag according to the present invention substantially departs from the conventional concepts and designs of the prior art, and in so doing provides an apparatus primarily developed for the purpose of increasing the visibility of the footbag in low light conditions such as at night.

SUMMARY OF THE INVENTION

In view of the foregoing disadvantages inherent in the known types of footbags now present in the prior art, the present invention provides a new illuminated footbag construction wherein the same can be utilized for increasing the visibility of the footbag in low light conditions such as at night.

The general purpose of the present invention, which will be described subsequently in greater detail, is to provide a new illuminated footbag apparatus and method which has many of the advantages of the footbags mentioned heretofore and many novel features that result in a new illuminated footbag which is not anticipated, rendered obvious, suggested, or even implied by any of the prior art footbags, either alone or in any combination thereof.

To attain this, the present invention generally comprises a generally translucent footbag having a cavity therein with a light source provided in the cavity for illuminating the footbag.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new illuminated footbag apparatus and method which has many of the advantages of the footbags mentioned heretofore and many novel features that result in a new illuminated footbag which is not anticipated, rendered obvious, suggested, or even implied by any of the prior art footbags, either alone or in any combination thereof.

It is another object of the present invention to provide a new illuminated footbag which may be easily and efficiently manufactured and marketed.

It is a further object of the present invention to provide a new illuminated footbag which is of a durable and reliable construction.

An even further object of the present invention is to provide a new illuminated footbag which is susceptible of a low cost of manufacture with regard to both materials and labor, and which accordingly is then susceptible of low prices of sale to the consuming public, thereby making such illuminated footbag economically available to the buying public.

Still yet another object of the present invention is to provide a new illuminated footbag which provides in the apparatuses and methods of the prior art some of the advantages thereof, while simultaneously overcoming some of the disadvantages normally associated therewith.

Still another object of the present invention is to provide a new illuminated footbag for increasing the visibility of the footbag in low light conditions such as at night.

Yet another object of the present invention is to provide a new illuminated footbag which includes a generally translucent footbag having a cavity therein with a light source provided in the cavity for illuminating the footbag.

Still yet another object of the present invention is to provide a new illuminated footbag that lets users play with the footbag in the dark to increase the usability of the footbag.

Even still another object of the present invention is to provide a new illuminated footbag that makes it easier to find a missing footbag in the dark.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
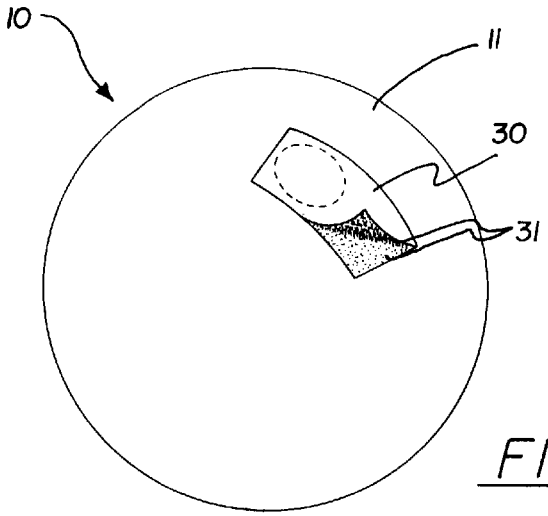
FIG. 1 is a schematic side view of a new illuminated footbag with a hook and loop fastener attached flap according to the present invention.

With reference now to the drawings, and in particular to FIGS. 1 through 10 thereof, a new illuminated footbag embodying the principles and concepts of the present invention will be described.

As best illustrated in FIGS. 1 through 10, the illuminated footbag comprises a generally translucent footbag 10 having a cavity 14 therein with a light source 16 provided in the cavity 14 for illuminating the footbag 10.

In closer detail the footbag 10 is generally spherical and has an integument 11 (or outer layer) and a core 12 comprising a plurality of generally spherical pellets 13. The footbag 10 typically has a diameter of about 2 inches and ideally each of the pellets 13 has a diameter of about ¼ inch. The integument 11 and the pellets 13 each comprise a generally translucent material to permit passage of light therethrough. Ideally, the pellets 13 each comprise a generally transparent material.

The footbag 10 has a cavity 14 therein with the integument 11 extending into the cavity 14. The cavity 14 has a generally circular mouth 15 formed on the exterior of the footbag 10. A light source is provided in the cavity 14 of the footbag 10 to illuminate the integument 11 and pellets 13 to permit viewing of the footbag 10 in low light conditions.

Figure 3:
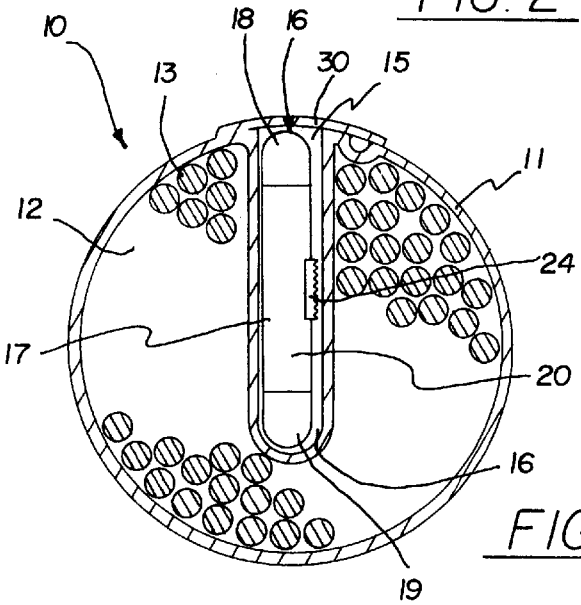
FIG. 3 is a schematic cross sectional view of the present invention taken from line 3—3 of FIG. 2.
Figure 4:
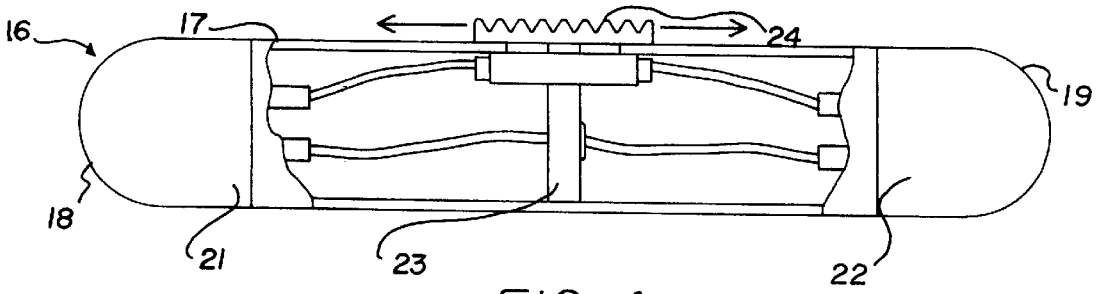
FIG. 4 is a schematic breakaway side view of the capsule of the present invention.

With reference to FIGS. 3 and 4, in one preferred embodiment, the light source 16 comprises a generally oblong elongate capsule 17 having a pair of opposite rounded ends 18,19 and a generally cylindrical middle portion 20. Each of the ends of the capsule 17 has a light emitting element 21,22 therein. The capsule 17 has a switch 24 provided on the middle portion for permitting selective activation of the light emitting elements 21,22. The capsule 17 also has a battery therein electrically connected to the light emitting elements 21,22 for powering the light emitting elements 21,22.

Figure 9:
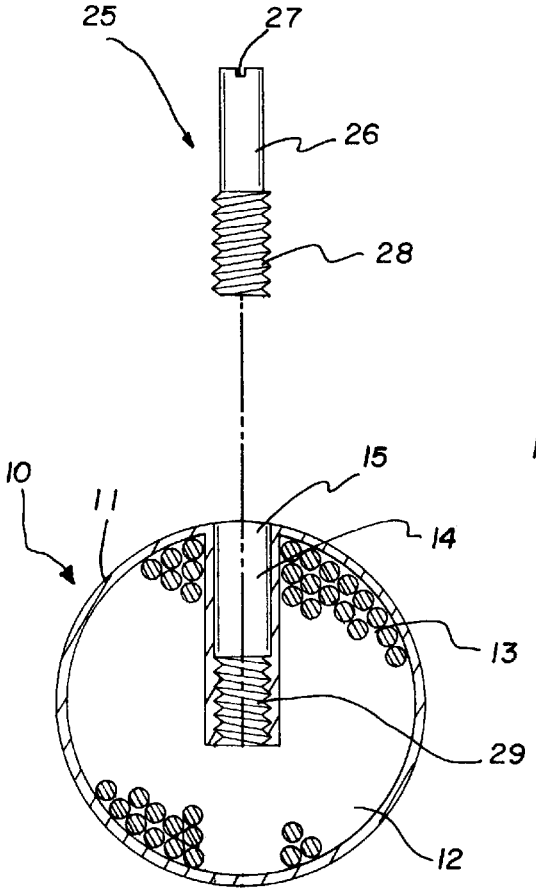
FIG. 9 is a schematic cross sectional view of the chemical light source embodiment of the present invention.

With reference to FIG. 9, in another preferred embodiment, the light source comprises a chemical glow tube 25 comprising a translucent elongate housing 26 containing a luminescent material therein. The housing 26 has a pair of opposite ends. The housing 26 is inserted in the cavity 14 such that a first of the ends of the housing 26 is positioned adjacent the mouth 15 of the cavity 14. The first end of the housing has a slot 27 designed for receiving a head of a screwdriver therein. Preferably, the cavity 14 has a threaded region 29 therein and the housing 26 has a complementary threaded portion 28 thereon. The threaded portion 28 of the housing 26 is located adjacent a second of the ends of the housing 26. The housing 26 is inserted into the cavity 14 such that the threaded portion 28 threadably engages the threaded region 29 of the cavity 14 to hold the housing 26 in the cavity 14.

Figure 2:
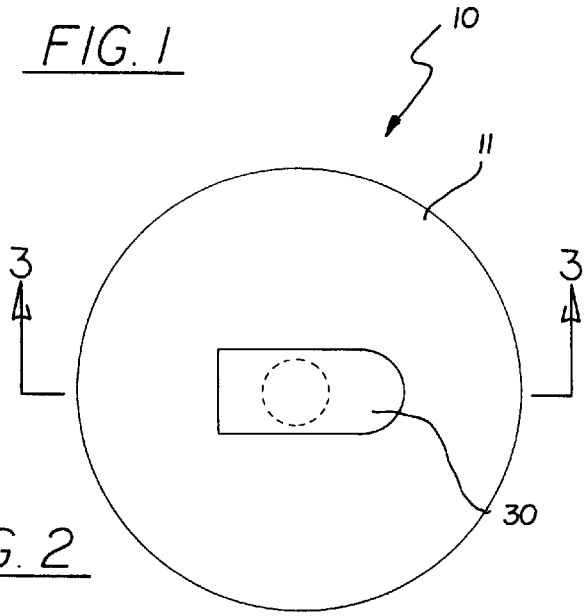
FIG. 2 is a schematic side view of the present invention with a snap fastened flap.

The footbag 10 preferably also has a closure for substantially closing the mouth 15 of the cavity 14. With reference to FIGS. 1, 2, and 3, the closure may preferably comprise a flap 30 extending from the integument 11 and substantially covering the mouth 15 of the cavity 14. The flap 30 is preferably detachably attached to a portion of the integument 11. In one ideal embodiment of this preferred embodiment, a hook and loop fastener 31 detachably attaches the flap 30 to the portion of the integument 11 (FIG. 2). In another ideal embodiment as illustrated in FIGS. 2 and 3, a snap fastener 32 detachably attached the flap 30 to the portion of the integument 11.

Figure 10:
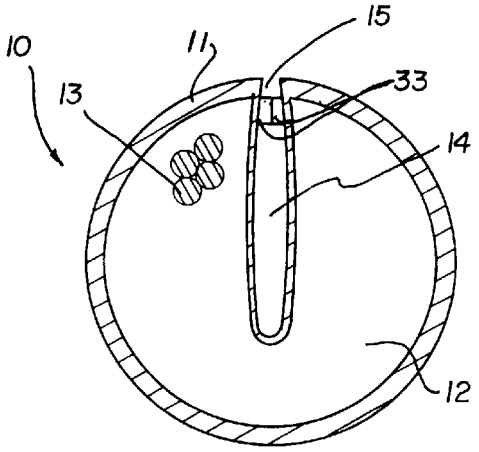
FIG. 10 is a schematic cross sectional view of a footbag of the present invention with a hook and loop fastener closure.

With reference to FIG. 10, in another preferred embodiment, the closure comprises a hook and loop fastener 33 such as the type sold under the tradename Velcro provided on the portion of the integument 11 in the cavity 14 adjacent the mouth 15 of cavity 14. In use, this hook and loop fastener 33 attaches generally diametric portions of the cavity 14 together to close the mouth of the cavity.

Figure 5:
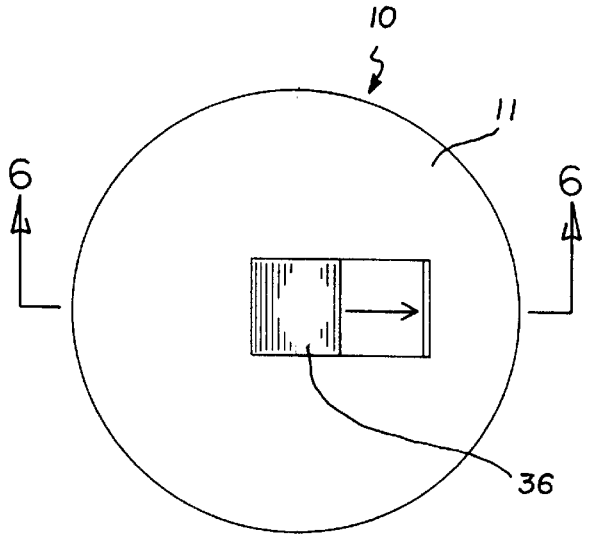
FIG. 5 is a schematic side view a slidable switch cap embodiment of the present invention.
Figure 6:
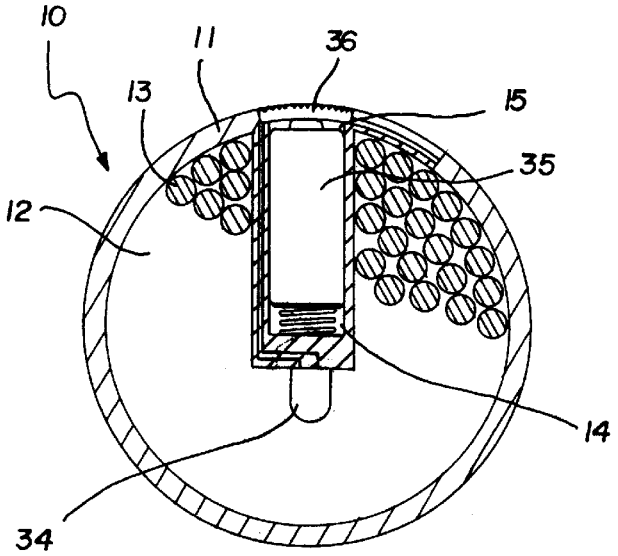
FIG. 6 is a schematic cross sectional view of the present invention taken from line 6—6.
Figure 7:
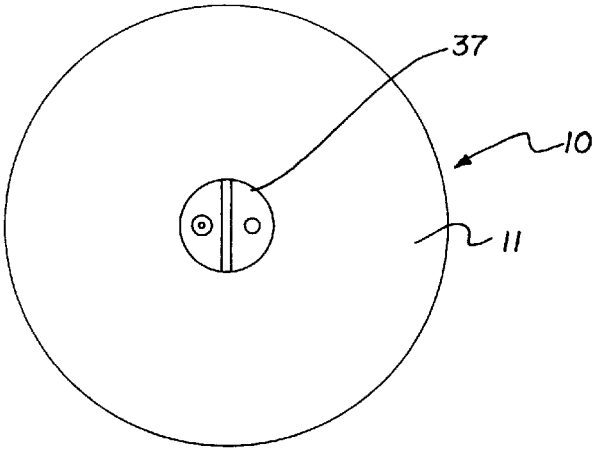
FIG. 7 is a schematic side view of a threaded cap.
Figure 8:
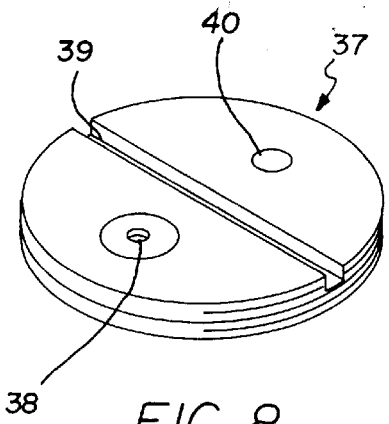
FIG. 8 is a schematic perspective view of the threaded cap.

FIGS. 5, 6, 7, and 8, illustrate a preferred embodiment of the footbag 10 where the light source comprises a LED (or optionally even a light bulb). In this embodiment, a battery 35 is provided in the cavity 14. The battery 35 is electrically connected to the LED light source 34. In one ideal embodiment, the closure comprises a switch cap 36 slidably mounted to the integument 11 as shown in FIG. 5 and 6. In use, sliding the switch cap 36 to a first position to substantially cover the mouth 15 of the cavity 14 completes a circuit to activate the LED light source 34. Sliding the switch cap 36 to a second position uncovers the mouth 15 of the cavity 14 and deactivates the LED light source 34. With reference to FIGS. 7 and 8, the closure may optionally comprise a threaded cap 37 threadably inserted into the mouth 15 of the cavity 14. The threaded cap 37 is generally disk shaped and has a push actuated switch 38 electrically connected to the LED light source 34 when the closure closes the mouth 15 of the cavity 14. In use, depression of the push actuated switch 38 selectively activates and deactivate the light source 34. The threaded cap 37 has a slot 39 designed for receiving a head of a screwdriver therein for aiding insertion and removal of the threaded cap 37 from the mouth 15 of the cavity 14. The threaded cap 37 may optionally also have a receptacle 40 designed for receiving an electrical cord to electrically connect the battery to a power source to recharge the battery.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An illuminated article, comprising:

a generally translucent footbag;

said footbag having a cavity therein;

a light source being provided in said cavity of said footbag; and wherein said footbag is generally spherical and having an integument and a core comprising a plurality of generally spherical pellets, and wherein said integument and said pellets each comprises a generally translucent material to permit passage of light therethrough, said integument extending into said cavity.

2. The illuminated article of claim 1, wherein said light source comprises a generally oblong elongate capsule having a pair of opposite ends and a generally middle portion, each of said ends of said capsule having a light emitting element therein, said capsule having a switch located on said middle portion for permitting selective activation of said light emitting elements.

3. The illuminated article of claim 2, wherein said ends of said capsule are rounded and said middle portion is generally cylindrical.

4. The illuminated article of claim 2, wherein said capsule has a battery therein electrically connected to said light emitting elements for powering said light emitting elements.

5. The illuminated article of claim 1, wherein said light source comprises a translucent elongate housing containing a luminescent material therein.

6. The illuminated article of claim 5, wherein said cavity of said footbag has a mouth, wherein said housing has a pair of opposite ends, said housing being inserted in said cavity such that a first of said ends of said housing is positioned adjacent said mouth of said cavity, said first end of having a slot adapted for receiving a head of a screwdriver therein.

7. The illuminated article of claim 6, wherein said cavity has a threaded region therein, wherein said housing has a threaded portion thereon, said threaded portion of said housing being located adjacent a second of said ends of said housing, said housing being inserted into said cavity such that said threaded portion threadably engages said threaded region of said cavity to hold said housing in said cavity.

8. The illuminated article of claim 1, wherein said cavity has a mouth, and wherein said footbag has a closure for substantially closing said mouth of said cavity.

9. The illuminated article of claim 8, wherein said closure comprises a flap extending from said integument and substantially covering said mouth of said cavity, said flap being detachably attached to a portion of said integument.

10. The illuminated article of claim 9, wherein a hook and loop fastener detachably attaches said flap to said portion of said integument.

11. The illuminated article of claim 9, wherein a snap fastener detachably attaches said flap to said portion of said integument.

12. The illuminated article of claim 8, wherein said closure comprises a hook and loop fastener provided on the portion of said integument in said cavity adjacent said mouth of cavity.

13. The illuminated article of claim 1, wherein said light source comprises a LED.

14. The illuminated article of claim 13, further comprising a battery being provided in said cavity, said battery being electrically connected to said light source.

15. The illuminated article of claim 14, wherein said cavity has a mouth, wherein said footbag has a closure substantially closing said mouth of said cavity, wherein said closure comprises a switch cap slidably mounted to said integument, wherein sliding said switch cap to a first position to substantially cover said mouth of said cavity activates said light source, wherein sliding said switch cap to a second position uncovers said mouth of said cavity and deactivates said light source.

16. The illuminated article of claim 14, wherein said cavity has a mouth, wherein said footbag has a closure substantially closing said mouth of said cavity, wherein said closure comprises a threaded cap threadably inserted into said mouth of said cavity, said threaded cap being generally disk shaped and having a push actuated switch electrically connected to said light source, said threaded cap having a slot adapted for receiving a head of a screwdriver therein.

17. An illuminated article, comprising:

a footbag being generally spherical and having an integument and a core comprising a plurality of generally spherical pellets;

said integument and said pellets each comprising a generally translucent material to permit passage of light therethrough;

said footbag having a cavity therein, said integument extending into said cavity, said cavity having a generally circular mouth;

a light source being provided in said cavity of said footbag;

said light source comprising a generally oblong elongate capsule having a pair of opposite rounded ends and a generally cylindrical middle portion, each of said ends of said capsule having a light emitting element therein, said capsule having a switch for permitting selective activation of said light emitting elements, said capsule having a battery therein electrically connected to said light emitting elements for powering said light emitting elements;

said footbag having a closure for substantially closing said mouth of said cavity; and wherein said closure comprises a hook and loop fastener provided on the portion of said integument in said cavity adjacent said mouth of cavity.

18. An illuminated article, comprising:

a generally translucent footbag;

said footbag having a cavity therein;

a light source being provided in said cavity of said footbag; and wherein said light source comprises a translucent elongate housing containing a luminescent material therein, said cavity of said footbag having a mouth, wherein said housing has a pair of opposite ends, said housing being inserted in said cavity such that a first of said ends of said housing is positioned adjacent said mouth of said cavity, said first end of having a slot adapted for receiving a head of a screwdriver therein.

* * * * *